US008490644B2

(12) United States Patent
Strachan

(10) Patent No.: US 8,490,644 B2
(45) Date of Patent: Jul. 23, 2013

(54) HOSE WINDING APPARATUS FOR AN IRRIGATION SPRINKLER SYSTEM

(76) Inventor: Michael Strachan, Vancouver (CA)

( * ) Notice: Subject to any disclaimer, the term of this patent is extended or adjusted under 35 U.S.C. 154(b) by 530 days.

(21) Appl. No.: 12/769,564

(22) Filed: Apr. 28, 2010

(65) Prior Publication Data

US 2011/0265888 A1 Nov. 3, 2011

(51) Int. Cl.
*B65H 75/34* (2006.01)

(52) U.S. Cl.
USPC ..... 137/355.16; 137/355.23; 137/355.2

(58) Field of Classification Search
USPC ..... 137/355.16, 355.2, 355.23, 355.26, 137/355.27
See application file for complete search history.

(56) References Cited

U.S. PATENT DOCUMENTS

| | | | | |
|---|---|---|---|---|
| 1,975,596 | A | 10/1934 | Adamson | |
| 2,518,990 | A | 8/1950 | Keener | |
| 3,471,885 | A | 10/1969 | McLoughlin et al. | |
| 3,810,579 | A | 5/1974 | Di Palma | |
| 3,939,862 | A * | 2/1976 | Booth | 137/355.16 |
| 4,186,881 | A * | 2/1980 | Long | 239/198 |
| 4,346,843 | A | 8/1982 | Long et al. | |
| 4,445,643 | A | 5/1984 | Thorsby et al. | |
| 4,538,761 | A | 9/1985 | Ruprechter et al. | |
| 6,752,342 | B1 | 6/2004 | Nagler | |
| 7,216,666 | B2 | 5/2007 | Levy et al. | |
| 2008/0295894 | A1 * | 12/2008 | Uffner et al. | 137/355.27 |
| 2011/0259444 | A1 * | 10/2011 | Caamano et al. | 137/355.26 |

FOREIGN PATENT DOCUMENTS

| | | |
|---|---|---|
| EP | 0 509 151 | 10/1992 |
| FR | 2359576 | 2/1978 |
| GB | 1367404 | 9/1974 |

* cited by examiner

*Primary Examiner* — John K Fristoe, Jr.
*Assistant Examiner* — Daphne M Barry
(74) *Attorney, Agent, or Firm* — Cameron IP

(57) ABSTRACT

A hydraulically powered, hose winding apparatus comprises a support and a hose reel rotatably mounted on the support. A hose is operatively coupled to the hose reel whereby the hose winds about the hose reel when the hose reel is rotated in a first direction. Rotation of the hose reel is driven by a cooperating valve mechanism and gear mechanism. The valve mechanism includes a turbine which is rotated by pressurized fluid flowing through the valve mechanism. The turbine is coupled the gear mechanism which transmits rotary motion from the turbine to the hose reel.

19 Claims, 4 Drawing Sheets

HOSE WINDING APPARATUS FOR AN IRRIGATION SPRINKLER SYSTEM

BACKGROUND OF THE INVENTION

1. Field of the Invention

The present invention relates to a sprinkler system and, in particular, to an irrigation sprinkler system provided with a hydraulically powered, hose winding apparatus.

2. Description of the Related Art

Home owners are known to install underground irrigation sprinkler systems which automatically irrigate their lawns. The underground sprinkler system is typically provided with plurality of strategically placed sprinklers to ensure even irrigation of the lawn. The underground sprinkler system may also be provided with timer set to irrigate the lawn at a predetermined time for at a predetermined duration. This is convenient because it does not require that an operator be available during the irrigation process. However, there are circumstances in which an underground sprinkler system may be neither available nor desirable. For example, the home owner may not be able to afford the cost of installing an underground sprinkler system. Alternatively, the cost of installing an underground sprinkler system may be difficult to justify if the house is being rented or sold.

Lawns are therefore frequently irrigated using an oscillating sprinkler. Oscillating sprinklers have a spray arm with a plurality of spaced apart nozzles along a longitudinal extent thereof. Pressurized fluid flowing to the oscillating sprinkler from a pressurized fluid supply is diverted into two streams. A portion of the fluid is diverted to actuate a cam that oscillates the spray arm. The remaining fluid is diverted to the spray arm where it is discharged through the nozzles. This causes a fan-shaped curtain of water to be sprayed over a rectangular area of the lawn. But lawns are often larger than the rectangular area covered by the oscillating sprinkler. The oscillating sprinkler must therefore be periodically moved to ensure even irrigation of the lawn. This is inconvenient because it requires that an operator be available during the irrigation process.

To overcome above disadvantage associated with oscillating sprinklers, it is known to use oscillating sprinklers in irrigation sprinkler systems which further include a hose winding apparatus and, in particular, a hydraulically powered, hose winding apparatus. Typically fluid flowing through the hose winding apparatus actuates a drive mechanism to rotate a hose reel. This draws the sprinkler along a substantially linear path towards the hose winding apparatus. Fluid is continuously discharged by the sprinkler as the sprinkler is drawn towards the hose winding apparatus, thereby allowing a larger area of lawn to be irrigated than would otherwise be possible with a stationary sprinkler.

U.S. Pat. No. 4,186,881 issued on Feb. 5, 2009 to Long discloses an irrigation sprinkler system which includes a portable vehicle having a hose reel connected to a pressurized fluid supply. A hose is carried by the reel and an end of the hose is connected to a travelling carriage having a water gun. The carriage is initially moved away from the vehicle by an external force. Fluid flowing through the system drives a turbine which rotates the hose reel and winds the hose thereon. The carriage and water gun are thereby drawn towards the vehicle at a selected speed so that a large area of earth is irrigated automatically.

U.S. Pat. No. 4,538,761 issued on Sep. 3, 1985 to Ruprechter et al. discloses an irrigation sprinkler system in which a hose reel is rotated by a pressurized fluid supply to wind up a hose. A hose guide is movable back and forth across the hose reel causing the hose to wind in layers on the hose reel. The hose guide is also coupled to a threaded spindle upon which a nut rides. A link connects the nut to a valve which throttles the flow of pressurized fluid to a hydraulically powered motor which progressively decreases the angular velocity of the hose reel as the hose is wound about the hose reel.

Yet, despite the disclosure of the above described systems; there remains a need for an inexpensive, compact hose winding apparatus that may be used in domestic applications.

SUMMARY OF THE INVENTION

It is an object of the present invention to provide an improved hose winding apparatus.

It is another object of the present invention to provide an inexpensive and compact hose winding apparatus that may be used in domestic applications.

There is accordingly provided a hydraulically powered, hose winding apparatus comprising a support and a hose reel rotatably mounted on the support. A hose is coupled to the hose reel whereby the hose winds about the hose reel when the hose reel is rotated in a first direction. Rotation of the hose reel is driven by a cooperating valve mechanism and a gear mechanism. The valve mechanism has an inlet port and an outlet port. The inlet port receives pressurized fluid from a pressurized fluid source. The outlet port is in fluid communication with the hose. A main conduit extends between the inlet port and the outlet port. A turbine is disposed along the main conduit between the inlet port and the outlet port. Pressurized fluid flowing through the valve mechanism rotates the turbine. The gear mechanism has a first gear coupled to the valve mechanism and a second gear coupled to the hose reel. The first gear is coupled to the turbine so that rotary motion is transmitted from the turbine to the first gear. The first gear transmits rotary motion from the turbine to the second gear. This causes the hose reel to rotate in the first direction and the hose to wind about the hose reel.

The valve mechanism may further include a bypass conduit that allows fluid to flow around the turbine. First and second valve members are disposed in the main conduit upstream of the turbine. The first valve member is disposed downstream of the bypass conduit and the second valve member is disposed upstream of the bypass conduit. There is a lever for actuating the first valve member to close the main conduit. The lever extends outwardly and upwardly of the support and the first valve member closes the main conduit when the lever is pushed towards the support. The first valve member may be a gate.

The gear mechanism may further include a third gear coupled to both the second gear and the second valve member. The second gear transmits motion to the third gear when the hose reel is rotated in the first direction. The third gear actuates the second valve member to incrementally close the main conduit when the hose reel is rotated in the first direction. The second valve mechanism may be a projection which is reciprocatingly extended into the main conduit to restrict or block the flow of the fluid through the main conduit. The gear mechanism may still further include a gear for ensuring even winding of the hose.

The present invention provides a hydraulically powered, hose winding apparatus that allows for even irrigation of a lawn without the requirement that an operator be available during the irrigation process.

BRIEF DESCRIPTIONS OF DRAWINGS

The invention will be more readily understood from the following description of the embodiments thereof given, by way of example only, with reference to the accompanying drawings, in which.

DESCRIPTION OF THE PREFERRED EMBODIMENTS

Figure 1:
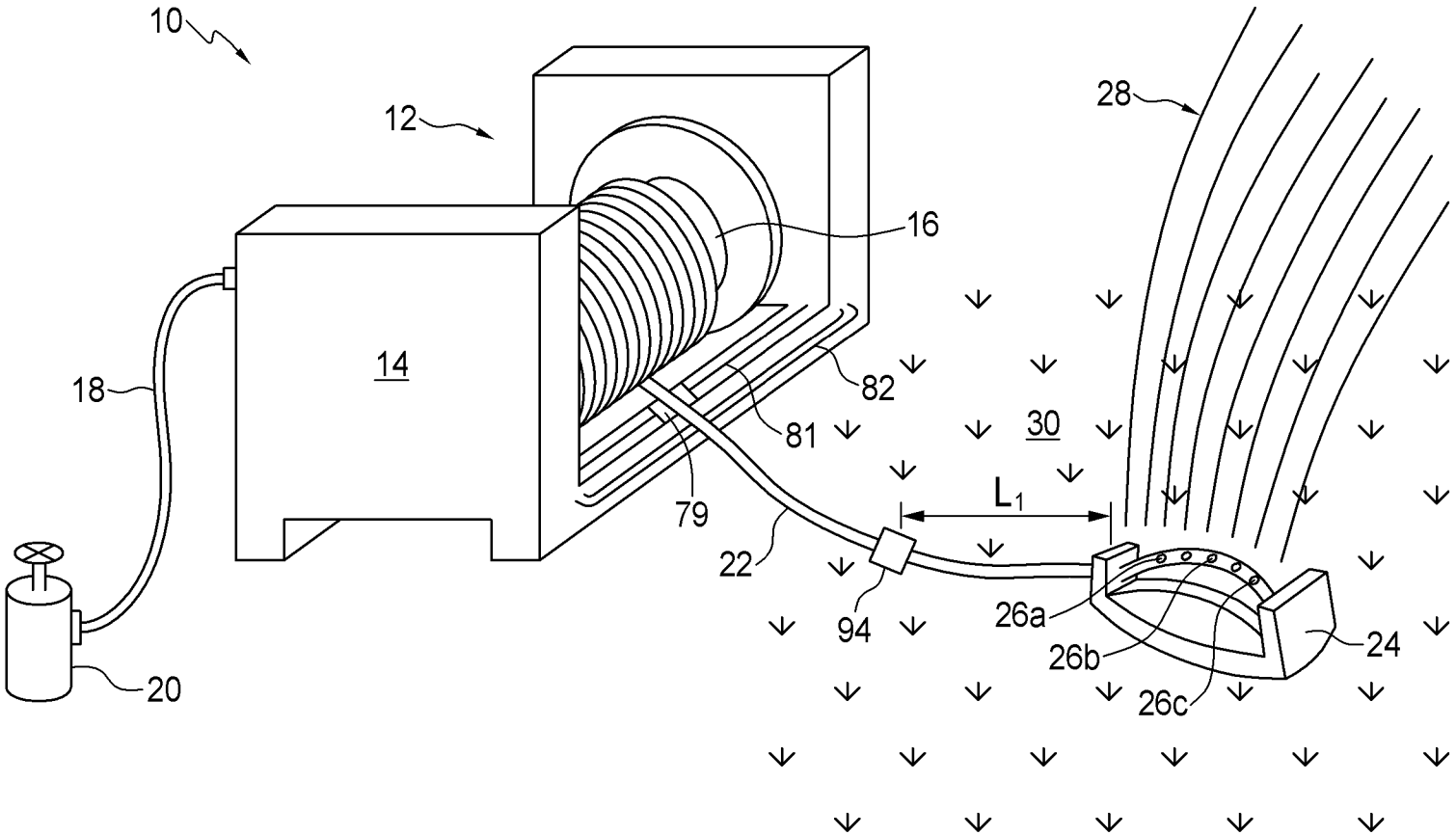
FIG. 1 is a perspective view of an irrigation sprinkler system provided with an improved and hydraulically powered, hose winding apparatus.

Referring to the drawings and first to FIG. 1, this shows an irrigation sprinkler system 10 provided with a hydraulically powered, hose winding apparatus 12. The hose winding apparatus 12 has a support 14 and hose reel 16 which is rotatably mounted on the support 14. In this example, the support 14 also functions as a housing. The sprinkler system 10 further includes an input hose 18 which maintains the hose winding apparatus 12 in fluid communication with a pressurized fluid supply 20. Preferably the fluid is water. An output hose 22 maintains the hose winding apparatus 12 in fluid communication with a sprinkler 24. In this example, the sprinkler 24 is an oscillating sprinkler though in other examples another type of sprinkler such as a rotatable sprinkler or pivotable sprinkler may be used.

Pressurized fluid flows from the pressurized fluid supply 20 to the hose winding apparatus 12 via the input hose 18. The pressurized fluid flows through the hose winding apparatus 12, and from the hose winding apparatus 12 to the sprinkler 24 via the output hose 22. The pressurized fluid is then discharged through a plurality of nozzles 26*a*, 26*b* and 26*c* on the sprinkler 24. This causes a fan-shaped curtain of fluid 28 to be sprayed over an area of a lawn 30 being irrigated. Simultaneously, pressurized fluid flowing through the hose winding apparatus 12 drives the hose reel 16 to rotate and thereby winds the output hose 22 about the hose reel 16. This causes the sprinkler 24 to be drawn towards the hose winding apparatus 12 and allows a larger area of the lawn 30 to be irrigated than would otherwise be possible if the sprinkler 24 remained stationary. The sprinkler system 10 is conventional as thus far described.

Figure 2:
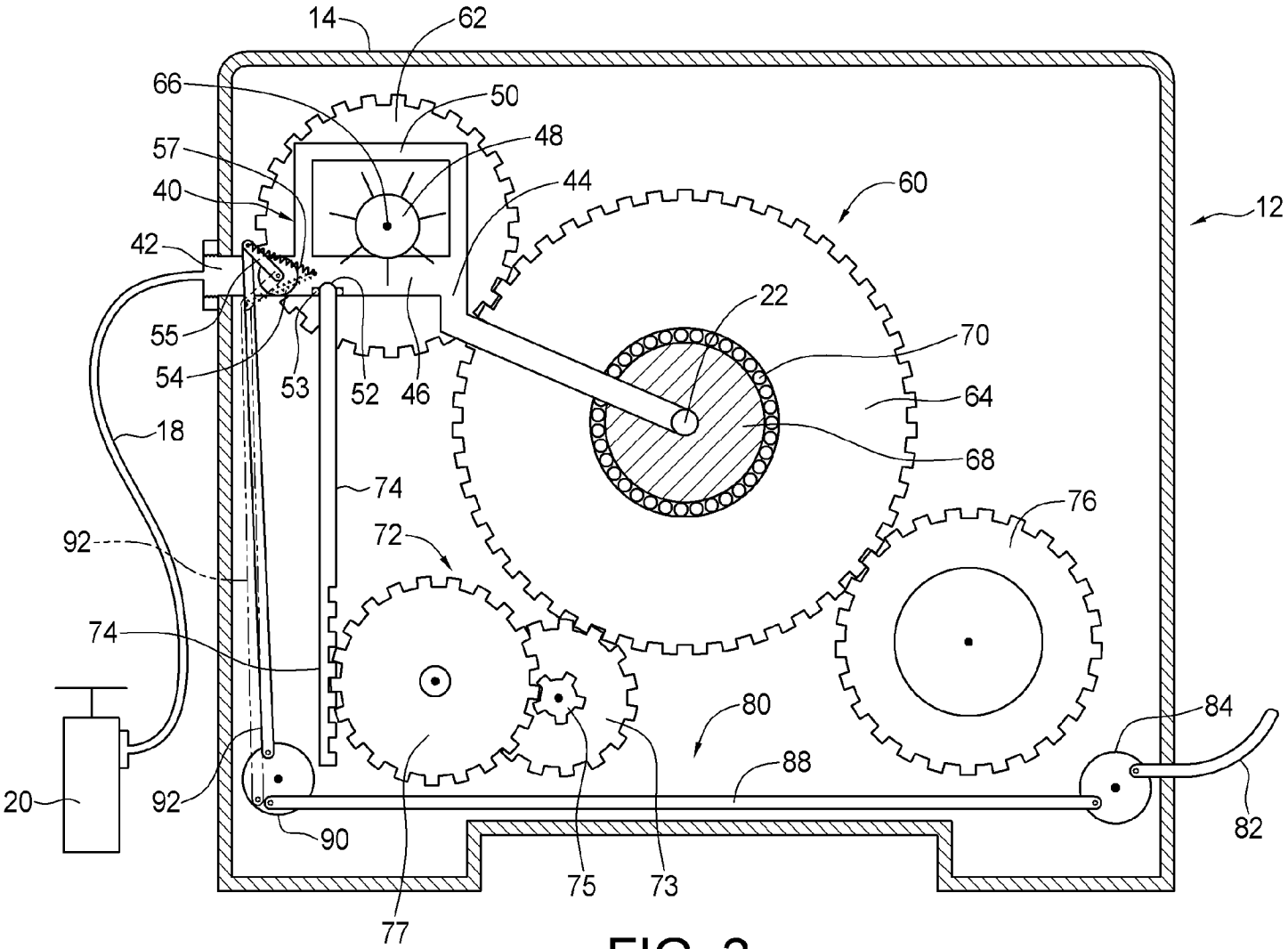
FIG. 2 is a side elevation view, partially in section, of the hydraulically powered, hose winding apparatus of FIG. 1.

However, the hose winding apparatus 12 of the sprinkler system 10 disclosed herein is provided with an improved mechanism for winding the output hose 22. As best shown in FIG. 2, the hose winding apparatus 12 includes a valve mechanism 40 and a gear mechanism 60. In this example, both the valve mechanism 40 and gear mechanism 60 are housed within the support 14. The valve mechanism 40 and gear mechanism 60 cooperate to rotate the hose reel 16, shown in FIG. 1, and thereby wind the output hose 22 about the hose reel 16.

Referring back to FIG. 2, the valve mechanism 40 includes an inlet port 42 and an outlet port 44. The inlet port 42 receives pressurized fluid from the pressurized fluid supply 20 via the input hose 18. The outlet port 44 is in fluid communication with the output hose 22. There is a main conduit 46 extending between the inlet port 42 and the outlet port 44. The valve mechanism 40 further includes a turbine 48 disposed along a linear portion of the main conduit 46 between the inlet port 42 and the outlet port 44. A bypass conduit 50 allows fluid to bypass around the turbine 48. There are also two valve members in the form of projection 52 and gate 54 disposed along the main conduit 46. The projection 52 and gate 54 are disposed upstream of the turbine 48.

Figure 3:
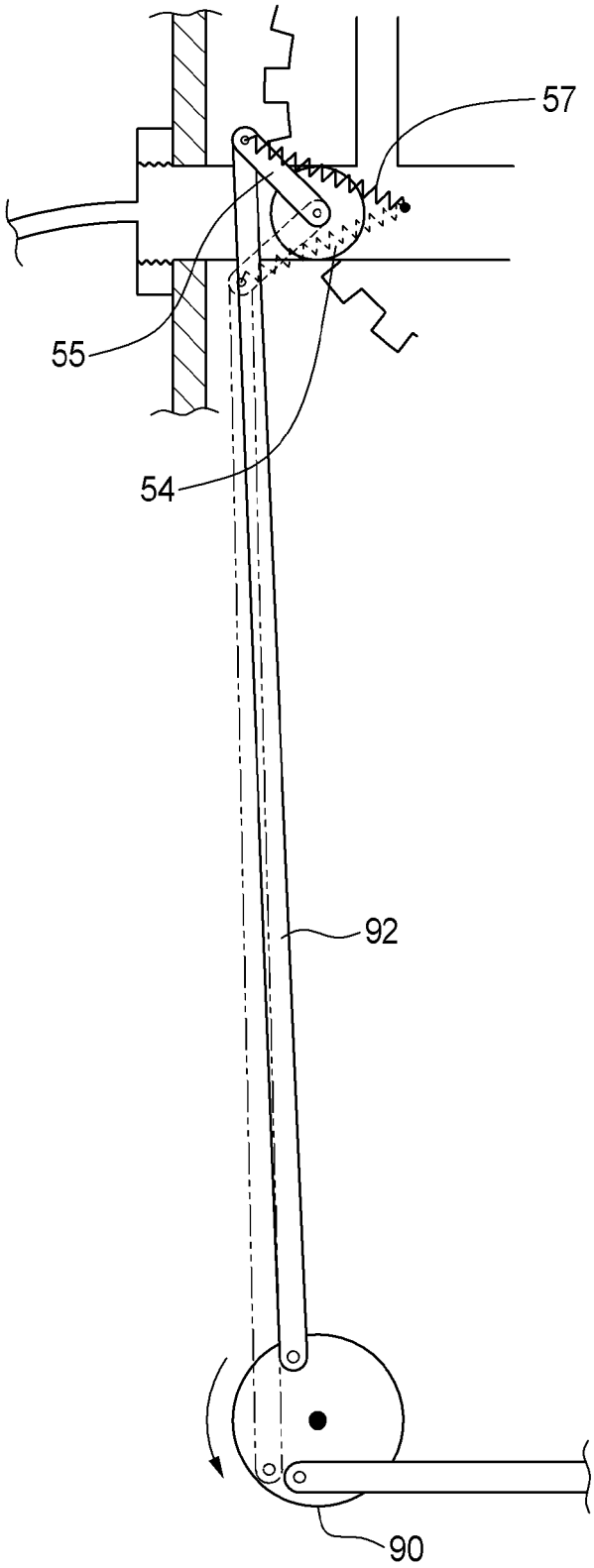
FIG. 3 is an enlarged side elevation view of a spring biased lever mechanism of FIG. 2.

The projection 52 may be incrementally and reciprocatingly extended into the main conduit 46 to restrict or block the flow of the fluid through the main conduit 46. An O-ring 53 disposed about the projection 52 seals the main conduit 46 with respect to the projection 52. The bypass conduit 50 is positioned to allow fluid to flow from the inlet port 42 to the outlet port 44 when the projection 52 blocks the main conduit 46. However, upstream access to the bypass conduit 50 is blocked when the gate 54 is closed. The gate 54 is actuated by a lever 55 which is movable between a position in which the gate 54 and a position in which the gate 54 is closed. The position of the lever 55 when the gate 54 is closed is shown in ghost in greater detail in FIG. 3. A resilient member in the form of a spring 57 biases the lever to the position in which the gate is open 54.

Referring back to FIG. 2, the gear mechanism 60 includes a first gear 62 and a second gear 64. The first gear is coupled to the turbine 48 by a pin 66. The second gear 64 is coupled to the hose reel 16 by a connecting member 68 which is supported by bearings 70 disposed in a wall of the support 14. The first and second gears 62 and 64 are meshed. The first gear 62 functions as a drive gear and the second gear 64 functions as a driven gear to rotate the hose reel 16.

The gear mechanism 60 further includes a gear train 72 which is meshed with the second gear 64. The gear train 72 including gears 73, 75 and 77 functions as an idler between the second gear 64 and a rack gear 74. The rack gear 74 is operatively connected to and reciprocatingly actuates the projection 52 of the valve mechanism 40. In this example, projection 52 of the valve mechanism 40 is a distal end of the rack gear 74. A third gear 76 is also meshed with the second gear 64. It will be understood by a person skilled in the art that the term "gear" as used herein is meant to include any mechanism that performs a specific function in the sprinkler system and is not to be restriction to the pinion gears shown in the drawings.

Figure 4:
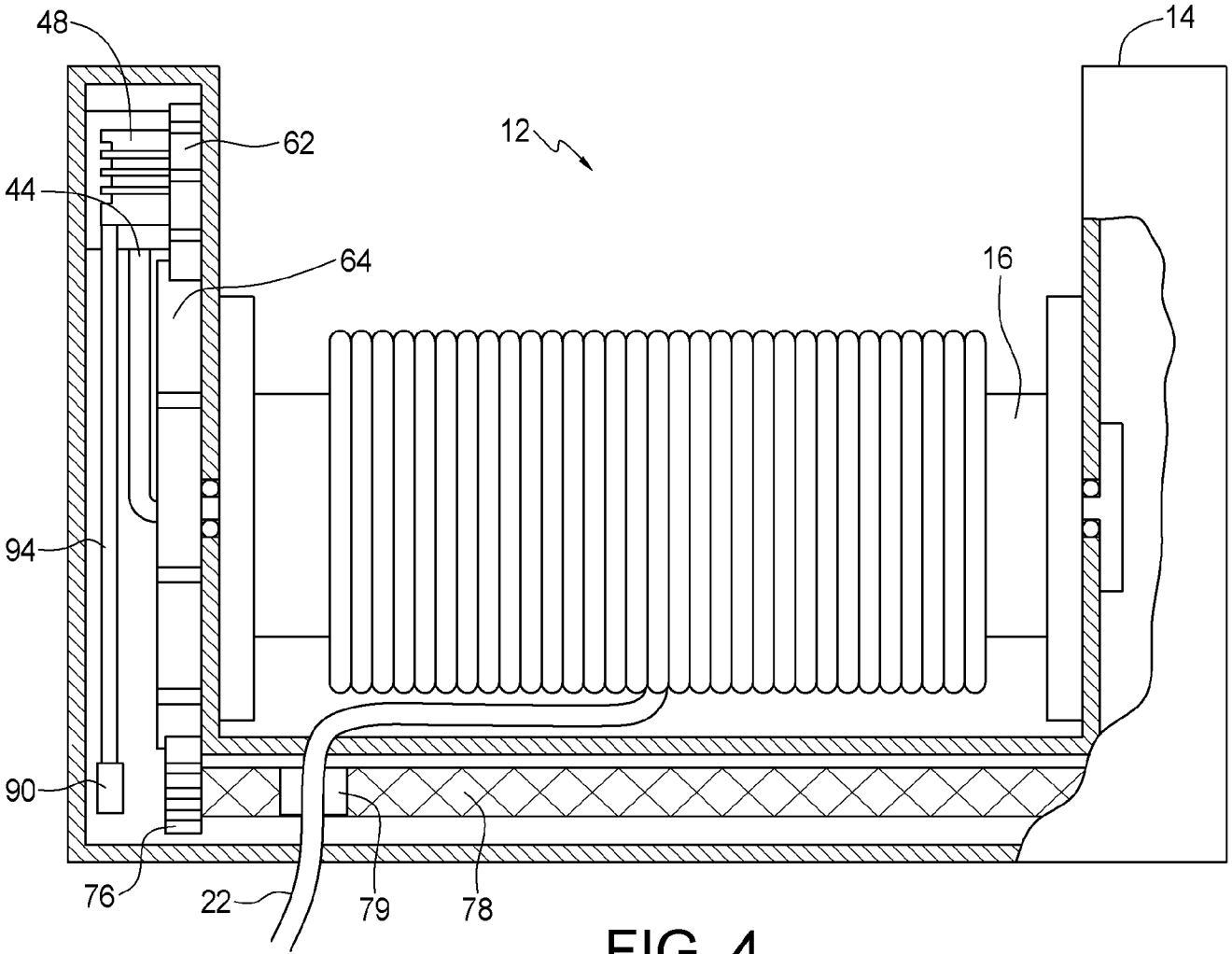
FIG. 4 is a front elevation view, partially in section, of the hydraulically powered, hose winding apparatus of FIG. 1.

As shown in FIG. 4, the third gear 76 functions as an idler between the second gear 64 and an opposing double helical gear 78. The opposing double helical gear guide 78 supports a hose guide 79 that ensures uniform winding of the output hose 22 about the hose reel 16 to ensure a regulated winding speed. In this example, the opposing double helical gear 78 makes four rotations for each rotation of the hose reel 16. As best shown in FIG. 1, the hose guide 79 extends though a slit 81 in the support 14 and reciprocating travels along the slit 81 as the opposing double helical gear 78, shown in FIG. 4, rotates. This is because the hose guide 79 engages the opposing double helical gear 78 and reciprocatingly travels along a length thereof and the double helical gear 78 rotates.

Referring back to FIG. 2, a shut-off mechanism 80 is also housed within the support 14. The shut-off mechanism 80 includes a lever 82 which extends outwardly and upwardly of the support 14. The lever 82 is coupled to a first disk 84 which is rotatably mounted within the support 14. A linking rod 88 couples the first disk 84 to a second disk 90 which is also rotatably mounted within the support 14. The second disk 90 is also coupled to the lever 55 which actuates the gate of the valve mechanism 40 by a linking rod 92.

In operation, and with reference to FIGS. 1 and 2, the sprinkler 24 is positioned away from the hose winding apparatus 12 at a desired location on the lawn 30. Pressurized fluid, preferably water, flows from the pressurized fluid supply 20 to the hose winding apparatus 12 via the input hose 18. The pressurized fluid flows through the hose winding apparatus 12 and, in particular, through the valve mechanism 40. Pressurized fluid flowing through the valve mechanism 40 rotates the turbine 48. Rotary motion is transmitted from the turbine 48 to the first gear 62 which, in turn, drives the second gear 64 to rotate the hose reel 16. This causes the output hose to wind about the hose reel 16 and the sprinkler 24 to be drawn towards the hose winding apparatus 12. Since pressurized fluid is allowed to flow through valve mechanism 40 to the sprinkler 24, pressurized fluid may be continuously discharged by the sprinkler 24 as it is drawn towards the hose winding apparatus 12.

The second gear 64 also simultaneously actuates the gear train 72 and third gear 74 as the hose reel 16 is being rotated. Actuation of the gear train 72 causes the rack gear 74 to extend the projection 52 of the valve mechanism 40 in the main conduit 46 thereof. This restricts the flow of pressurized fluid past the turbine 48 and thereby slows the rotation of the hose reel 16 as the sprinkler 24 approaches the hose winding apparatus 12. The bypass conduit 50 allows a constant fluid pressure to be provided to the sprinkler 24 so that fluid may be continuously discharged by the sprinkler 24 as it is drawn towards the hose winding apparatus 12. Rotation of the third gear 76 cause the opposing double helical gear 78 to rotate and the hose guide 79 to reciprocatingly travel along the slit 81 in the support 14. This ensures uniform winding of the output hose 22 about the hose reel 16.

The sprinkler 24 pushes the lever 82 into the support 14 of the hose winding apparatus 12 when the sprinkler 24 comes into contact with the hose winding apparatus 12. As best shown in FIG. 1, the lever 82 extends along a longitudinal side of the support 14. This ensures that the sprinkler 24 will push the lever 82 into the support 14 of the hose winding apparatus 12 regardless of the position of the output hose 22 when the sprinkler 24 makes contact with the hose winding apparatus 12. Pushing the lever 82 into the support 14 of the hose winding apparatus 12 causes the first disk 84 to rotate. Rotation of the first disk 84 causes the second disk 90 to also rotate. Rotation of the second disk 90 causes the linking rod 92 to move, thereby moving the lever 55 to a position in which the gate 54 is closed. This is shown in ghost in FIG. 2 and in greater detail in FIG. 3. Closing the gate 54 blocks the flow of fluid through the valve mechanism 40 and the sprinkler 24 is shut-off.

As shown in FIG. 1, a clamp 94 may be secured about the output hose 22 in which case the clamp 94 will push the lever 82 into the support 14 of the hose winding apparatus 12. This will leave a length $L_1$ of the output hose 22 unwound when the sprinkler 24 is shut-off. This may be desirable when only a certain area of the lawn 30 is to be watered or there is a gap, e.g. a concrete driveway, between the lawn 30 and the hose winding apparatus.

The present invention accordingly provides a hydraulically powered, hose winding apparatus that allows for even irrigation of a lawn without the requirement that an operator be available during the irrigation process.

It will be understood by a person skilled in the art that many of the details provided above, are by way of example only, and are not intended to limit the scope of the invention which is to be determined with reference to following claims.

What is claimed is:

1. A hydraulically powered hose winding apparatus, comprising:

a support;

a hose reel rotatably mounted on the support;

a hose coupled to the hose reel, the hose winding about the hose reel when the hose reel is rotated in a first direction;

a valve mechanism having an inlet port for receiving pressurized fluid from a pressurized fluid supply, an outlet port in fluid communication with the hose, a main conduit extending between the inlet port and the outlet port, and a turbine disposed along the main conduit between the inlet port and the outlet port;

a gear mechanism having a first gear coupled to the valve mechanism and a second gear coupled to the hose reel, the first gear being coupled to the turbine so that rotary motion is transmitted from the turbine to the first gear when pressurized fluid flows through the valve mechanism, and the first gear transmitting rotary motion from the turbine to the second gear when pressurized fluid flows through the valve mechanism, thereby causing the hose reel to rotate in the first direction and the hose to wind about the hose reel; and a valve member disposed in the main conduit of the valve mechanism upstream of the turbine and a gear for actuating the valve member to incrementally close the main conduit when the hose reel is rotated in the first direction, thereby restricting pressurized fluid flow past the turbine and slowing rotation of the hose reel in the first direction as the hose winds about the hose reel.

2. The hose winding apparatus as claimed in claim 1 wherein the valve mechanism is housed within the support.

3. The hose winding apparatus as claimed in claim 1 wherein the gear mechanism is housed within the support.

4. The hose winding apparatus as claimed in claim 1 wherein the gear for actuating the valve member to incrementally close the main conduit when the hose reel is rotated in the first direction is meshed with the gear mechanism.

5. The hose winding apparatus as claimed in claim 1 further including a valve member disposed in the main conduit of the valve mechanism upstream of the turbine, and a lever for actuating the valve member to close the main conduit when the lever actuated.

6. The hose winding apparatus as claimed in claim 5 wherein the lever extends outwardly of the support and the valve member closes the main conduit when the lever is pushed towards the support.

7. The hose winding apparatus as claimed in claim 1 wherein the valve mechanism further includes a bypass conduit for allowing for fluid to flow around the turbine.

8. The hose winding apparatus as claimed in claim 1 further including a gear for ensuring even winding of the hose.

9. The apparatus as claimed in claim 8 wherein the gear for ensuring even winding of the hose is meshed with the gear mechanism.

10. A hydraulically powered hose winding apparatus, comprising:

a support;

a hose reel rotatably mounted on the support;

a hose coupled to the hose reel, the hose winding about the hose reel when the hose reel is rotated in a first direction;

a valve mechanism having an inlet port for receiving pressurized fluid from a pressurized fluid supply, an outlet port in fluid communication with the hose, a main conduit extending between the inlet port and the outlet port, a turbine disposed along the main conduit between the inlet port and the outlet port, and first and second valve members disposed in the main conduit upstream of the turbine;

a lever for actuating the first valve member to close the main conduit when the lever is actuated; and a gear mechanism having a first gear coupled to the turbine so that rotary motion is transmitted from the turbine to the first gear when pressurized fluid flows through the valve mechanism, a second gear coupled to the first gear and the hose reel wherein the first gear transmits rotary motion from the turbine to the second gear when pressurized fluid flows through the valve mechanism and causes the hose reel to rotate in the first direction and the hose to wind about the hose reel, and a third gear coupled to both the second gear and the second valve member wherein the second gear transmits motion to the third gear when the hose reel is rotated in the first direction and causes the third gear to actuate the second valve member to incrementally close the main conduit when the hose reel is rotated in the first direction, thereby restricting pressurized fluid flow past the turbine and slowing rotation of the hose reel in the first direction as the hose winds about the hose reel.

11. The hose winding apparatus as claimed in claim 10 wherein the lever extends outwardly of the support and the valve member closes the main conduit when the lever is pushed towards the support.

12. The hose winding apparatus as claimed in claim 10 wherein the valve mechanism further includes a bypass conduit for allowing for fluid to flow around the turbine.

13. The hose winding apparatus as claimed in claim 12 wherein the first valve member is disposed downstream of the bypass conduit and the second valve member is disposed upstream of the bypass conduit.

14. The hose winding apparatus as claimed in claim 10 further including a gear for ensuring even winding of the hose.

15. The apparatus as claimed in claim 14 wherein the gear for ensuring even winding of the hose is a double helical gear which is meshed with the gear mechanism.

16. The apparatus as claimed in claimed in claim 14 further including a hose guide coupled to the gear for ensuring even winding of the hose.

17. The apparatus as claimed in claim 10 further including a clamp disposed along a length of the hose for actuating the lever.

18. A mechanism winding a hose about a hose reel of a hose winding apparatus, the mechanism comprising:

a valve mechanism having an inlet port for receiving pressurized fluid from a pressurized fluid supply, an outlet port in fluid communication with the hose, a main conduit extending between the inlet port and the outlet port, a turbine disposed along the main conduit between the inlet port and the outlet port, first and second valve members disposed in the main conduit upstream of the turbine, and a bypass conduit for allowing for fluid to flow around the turbine wherein the first valve member is disposed downstream of the bypass conduit and the second valve member is disposed upstream of the bypass conduit;

a lever for actuating the first valve member to close the main conduit when the lever is actuated; and a gear mechanism having a first gear coupled to the turbine so that rotary motion is transmitted from the turbine to the first gear when pressurized fluid flows through the valve mechanism, a second gear coupled to the first gear and the hose reel wherein the first gear transmits rotary motion from the turbine to the second gear when pressurized fluid flows through the valve mechanism and causes the hose reel to rotate in a first direction and the hose to wind about the hose reel, and a third gear coupled to both the second gear and the second valve member wherein the second gear transmits motion to the third gear when the hose reel is rotated in the first direction and causes the third gear to actuate the second valve member to incrementally close the main conduit when the hose reel is rotated in the first direction, thereby restricting pressurized fluid flow past the turbine and slowing rotation of the hose reel in the first direction as the hose winds about the hose reel.

19. The mechanism as claimed in claim 18 further including is a double helical gear which is meshed with the gear mechanism for ensuring even winding of the hose.

* * * * *